United States Patent [19]

Martus

[11] 4,454,491

[45] Jun. 12, 1984

[54] TEMPERATURE SENSING CIRCUIT BREAKER OR SWITCH

[75] Inventor: Charles R. Martus, Redford Township, Wayne County, Mich.

[73] Assignee: Allied Corporation, Morris Township, Morris Co., N.J.

[21] Appl. No.: 376,360

[22] Filed: May 10, 1982

[51] Int. Cl.[3] ..... H01H 51/00

[52] U.S. Cl. ..... 335/208; 335/146

[58] Field of Search ..... 335/208, 146

[56] References Cited

U.S. PATENT DOCUMENTS

| | | | |
|---|---|---|---|
| 2,718,569 | 9/1955 | Johnston | 335/208 |
| 3,292,124 | 12/1966 | Legvold | 335/146 |
| 3,760,310 | 9/1973 | Carson | 335/208 |
| 4,383,231 | 5/1983 | Yamanaka et al. | 335/208 |
| 4,414,519 | 11/1983 | Anderson | 335/208 |

*Primary Examiner*—Harold Broome

*Attorney, Agent, or Firm*—James P. DeClercq

[57] ABSTRACT

A circuit breaker or switch utilizes the Curie point temperature characteristics of an amorphous ferromagnetic metal in cooperation with a magnet to make or interrupt an electrical circuit upon the amorphous material being heated to its Curie point temperature. The circuit breaker has a planar base member with a raised projection which supports a stationary contact member so that the movable contact member overhangs the stationary contact member. The movable contact member is provided with a number of layers of amorphous ferromagnetic material, disposed adjacent the stationary contact, bringing the movable contact member into electrical contact with the stationary contact member. Upon reaching its Curie point temperature, the amorphous ferromagnetic material will become paramagnetic or nonmagnetic material, so that the inherent resiliency of the movable contact material causes the electrical circuit to be made or broken.

4 Claims, 4 Drawing Figures

TEMPERATURE SENSING CIRCUIT BREAKER OR SWITCH

This application is related to the field of temperature-sensing electrical switches. In particular, this invention relates to a circuit breaker or switch utilizing the Curie temperature of an amorphous material to operate the circuit breaker or switch.

BACKGROUND OF THE INVENTION

Circuit breakers and switches for interrupting or making an electrical circuit when excessive current is drawn, or when electrically-operated equipment becomes too warm are known, and typically include a laminated bimetallic element, the two materials of the laminated bimetallic element having different coefficients of expansion with temperature, so that the bimetallic element curls and straightens as its ambient temperature is raised and lowered, by variations in surrounding air temperature, variation in current flowing through the bimetallic element, or current flowing through an associated heating resistor. Conventionally, this bimetallic element carries the movable element of a contact pair, which is moved towards or away from a fixed contact as temperature changes, and gradually establishes or breaks contact with the fixed contact, to allow or stop the flow of current through the fixed and stationary contacts. As will be apparent, gradual engagement and disengagement causes rapid wear of the contacts and early failure of the circuit breaker. To overcome this problem, bimetallic elements have been formed with cutout sections, or with curved cross sections, to provide a snap action.

However, heating the bimetallic element affects the characteristics of the bimetallic element. The materials of the bimetallic element are heat-treated, mechanically-treated and tempered, for particular granular characteristics that give the metal its desired properties of hardness, resilience, and so forth. Heating causes undesirable but unavoidable further tempering, which causes a gradual growth in grain size, and a gradual change in temperature and fatigue-resistant characteristics of the material. Thus, the operating temperature of a conventional bimetallic switch may change over time, and the bimetallic element may fail prematurely due to decreased fatigue resistance.

It has also been proposed to use the Curie temperature characteristics of a magnetic material to provide a temperature switch, such as in soldering iron temperature switches disclosed in U.S. Pat. Nos. 2,951,927 and 3,287,541, to operate a separate switching mechanism. However, magnetic materials previously used for their Curie temperature characteristics do not switch from magnetic to paramagnetic or non-magnetic characteristics abruptly, but rather begin a change at a measured Curie temperature, and complete the change at a higher temperature, leading to the disadvantage of gradual switch operation. It is also known that the Curie temperature of a magnetic material may depend on its prior history, in terms of mechanical working, heat-treating and tempering. The instant invention provides a solution to these and other problems of known circuit breakers.

SUMMARY OF THE INVENTION

It has been found that certain amorphous materials, such as those available from Allied Corporation of Morristown, N.J., U.S.A., under the registered trademark METGLAS have desirable characteristics for use in thermal switches and circuit breakers. Amorphous metals, often referred to as glassy metals, have the amorphous structure of a glass. Not having a grain structure, it is believed that such materials do not change in magnetic characteristics or Curie temperatures with heating or age, and it is believed that the absence of granular structure results in a sharp and well-defined Curie point temperature, the magnetic domains of the magnetic material not being constrained to remain aligned with a previously applied magnetic field by granular boundaries. Amorphous metals with suitable magnetic characteristics may be manufactured in accordance with the teachings of U.S. Pat. Nos. 4,260,007, 4,221,257, 4,202,404, 4,142,571 and 3,960,200, hereby incorporated by reference, as well as other patents and publications. The use of such an amorphous metal in a circuit breaker according to the invention also allows the contact-carrying element to be a conventional material selected for its ability to carry current, without the inclusion of any elements or alloys that impair its current-carrying ability.

Various items of electrically-operated equipment, such as motors, audio amplifiers, radio and television receivers, and other similar items of consumer electronics are conventionally provided with a circuit breaker, to ensure that excessive current is not drawn, indicative of a component failure, and excessive temperature is not attained, which may cause failure of semiconductor components and other devices.

A circuit breaker according to the present invention provides a simplified, inexpensive, dependable and repeatable structure for a circuit breaker adapted for such a use.

Thus, it is an object of the invention to provide a circuit breaker utilizing a movable contact-carrying element folded over or wrapped around a plurality of strips of amorphous metallic material, disposed adjacent to a magnet and attracted to the magnet when the temperature of the amorphous metallic material is below its Curie point temperature or a movable contact-carrying element folded or wrapped around a magnet, disposed adjacent to a plurality of strips of amorphous metallic material, and attracted to the metallic material when its temperature is below its Curie point temperature. It is an advantage of this arrangement that current need not be passed through the active element of the temperature switch, allowing the amorphous metal to be selected considering its Curie temperature only, while the contact-carrying elements may be selected on the basis of their current-carrying capability. It is a feature of the preferred embodiments of the invention that the strip or strips of amorphous metal used may be conveniently varied in number to vary the degree to which the movable element is attracted towards the magnet, to allow the material of the movable element to be selected without regard for its degree of resilience, since forces involved may be adjusted by varying the amount of amorphous metallic material.

BRIEF DESCRIPTION OF THE DRAWINGS

Other objects, advantages and features of the invention will become apparent from the drawings and detailed description which follow.

DETAILED DESCRIPTION OF THE INVENTION

Figure 1:
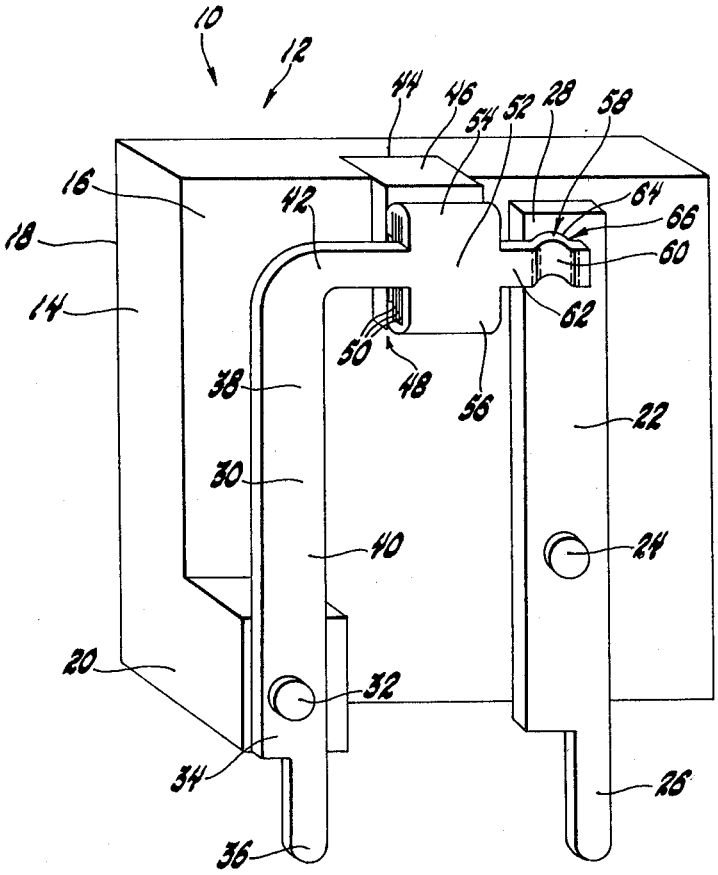
FIG. 1 is a perspective view of a normally-closed circuit breaker or switch according to a first preferred embodiment of the invention.

Referring to FIG. 1, a perspective view of a circuit breaker or switch according to the first preferred embodiment of the invention is shown. As will be apparent, such a circuit breaker may be provided with mounting feet to be attached by means of screws or rivets of the like to a mounting surface, or may be adhesively attached to a mounting surface such as, for example, a transistor heat sink, and may further be enclosed by a conventional extruded metallic can in conventional manner, such as with the edges of the can crimped around the base of the illustrated circuit breaker. Such a can may also be provided with mounting feet. Or, a molded plastic member in the shape of an extruded can or the like may also be used if it is desired to cover or protect a circuit breaker according to the invention.

Referring to FIG. 1, circuit breaker 10 has a base member 12 including a generally planar portion 14 having a first surface 16 and a second surface 18 substantially parallel to surface 16. Preferably, planar portion 14 has a rectangular configuration, as illustrated. Base member 12 includes a projecting portion 20 of any appropriate shape, illustrated as a rectangular projection from first surface 16 of base member 12. The purpose of projecting portion 20 is to establish a clearance in open condition between conducting elements of circuit breaker 10. As illustrated, projection portion 20 is located at a corner of generally planar portion 14 although, as will be apparent, other equivalent conditions and positions will be apparent and may be easily substituted to serve the same purpose. As will be apparent, base member 12 is formed of an insulating material, and is preferably molded from a conventional plastic.

A stationary contact member 22, formed of any suitable electrically-conductive material, is fastened to first surface 16, such as by fastening means shown as a rivet 24, although adhesive fastening, heat stake or ultrasonic welding of a molded plastic post of member 12 may also be used, if desired. As shown, stationary contact member 22 includes a terminal portion 26 extending beyond base member 12, which may be configured in the form of a conventional quick-connect contact, a simple tab or flat blade adapted to take a push-on, force-fit metal sleeve installed on a wire end. Direct soldering to a printed circuit board may also be used to make electrical connection to a circuit breaker according to the invention. Preferably, stationary contact member 22 is an uncomplicated flat stamping, although, as will be apparent, a conventional contact button may be added to stationary contact member 22 in contact area 28. Projecting portion 20 supports a movable contact member 30, fastened to projection portion 20 by fastening means shown as rivet 32. Hot staking or ultrasonic welding may also be used, as stated above. As shown, movable contact member 30 has a widened portion 34 in contact with projection portion 20 for supporting the cantilevered portions of movable contact member 30. Movable contact member 30 includes a terminal portion 36 which is preferably identical to terminal portion 26, and a cantilevered portion 38 which intersects contact area 28 of stationary contact member 22. Cantilevered portion 38 is shown as an L-shaped member having a long portion 40 and a perpendicular short portion 42, although, as will be apparent, cantilevered portion 38 could be made a straight portion, if desired, and base member 12 suitably modified such as by enlarging planar portion 14 of base member 12.

First surface 16 of base member 12, as shown, defines a cavity 44 adjacent contact area 28 of stationary contact member 22, adapted to contain a magnet 46, illustrated as projecting a short distance above first surface 16. As will be apparent, the position of magnet 46 with respect to first surface 16 is a matter of mechanical choice, considering the thicknesses of the relevant portions of stationary contact member 22 and movable contact member 30, the provisions for contact buttons, if any, the height of projecting portion 20, and the thickness of amorphous metallic material 48. Amorphous metallic material 48 may be comprised of a number of strips of amorphous metallic material, forming a plurality of layers 50.

As shown, short portion 42 is provided with an enlarged portion 52, defining a pair of first and second bendable tabs 54 and 56, which are bent around material 48 to hold it in place on short portion 42. It will be appreciated that a conventional clamping means or retaining clip may also be useful with such amorphous metallic materials, and that conventional adhesives may also be used to aid in retaining amorphous metallic material 48 to movable contact member 30.

Amorphous metallic material 48 may be formulated with any one of a number of compositions to achieve different Curie point temperatures. In the preferred embodiment of the invention, an amorphous metallic material having the composition $Fe_{33}Ni_{40}Mo_4B_{11}Si_{12}$ is used, and has a Curie temperature point of 218° F. (104° C.). Other suitable formulations include variations of this composition, of the general formula $Fe_xNi_{73-x}Mo_4B_{11}Si_{12}$, it having been found that the Curie point temperature of such a composition varies about 10° C. (18° F.) for each one percent change in ratio of iron (Fe) to nickel (Ni). For instance, the composition $Fe_{16}Ni_{57}Mo_4B_{11}Si_{12}$ has been found to have a Curie point temperature of −96° C. (−141° F.), $Fe_{27}Ni_{46}Mo_4B_{11}Si_{12}$ has been found to have a Curie point temperature of 32° C. (87° F.), $Fe_{33}Ni_{40}Mo_4B_{11}Si_{12}$ has been found to have a Curie point temperature of 96° C. (206° F.), and $Fe_{36}Ni_{37}Mo_4B_{11}Si_{12}$ has been found to have a Curie point temperature of 138° C. (280° F.). Also, various amorphous metal compositions having about 80 percent iron (Fe) and molybdenum (Mo) and 20 percent beryllium (B) have been found to have Curie point temperatures of higher values. For instance, $Fe_{74}Mo_7B_{19}$ has a Curie point temperature of 145° C. (292° F.), $Fe_{72.5}Mo_{7.5}B_{20}$ has a Curie point temperature of 150° C. (301° F.), $Fe_{75}Mo_{5.5}B_{19.5}$ has been found to have a Curie point temperature of 180° C. (355° F.), $Fe_{76}Mo_4B_{20}$ has been found to have a Curie point temperature of 195° C. (382° F.), and $Fe_{78}Mo_{3.5}B_{18.5}$ has been found to have a Curie point temperature of 235° C. (454° F.).

As illustrated, movable contact member 30 is provided with a contact portion 58, illustrated as a simple indentation 60 in a first surface 62, forming a protrusion 64 in second surface 66. This provides a simple contact portion providing a controllable contact pressure over a limited area, to establish good electrical contact between stationary contact member 22 and movable contact member 30 when amorphous metallic material 48 is at a temperature below its Curie point temperature and is attracted to magnet 46. When the temperature of amorphous metallic material 48 exceeds its Curie point temperature, it will become a paramagnetic or nonmagnetic material, and the inherent resilience of movable contact member 30 will cause contact portion 58 to separate from contact area 28, opening the electrical circuit between terminal portions 26 and 36. This heat may either be ambient heat, heating all portions of circuit breaker 10, or may be Joule heating caused by the passage of excessive current through movable contact member 30. Thus, if the cause of the high ambient temperature is electrical in nature, opening the circuit between terminals 26 and 36 will result in cooling, cooling amorphous metallic material 48 until it again becomes a magnetic material, attracted to magnet 46, and closing the electrical circuit between terminals 26 and 36. If amorphous metallic material 48 was heated by excessive current, interruption of the current will allow amorphous metallic material 40 to cool below its Curie point temperature and reestablish electrical continuity. Thus, the conductivity of the material used for movable contact member 30, and its cross-sectional area may be varied to increase its resistance, allowing circuit breaker 10 to be used as a flasher, if desired. However, circuit breaker 10 is preferably used to protect an electronic item, and force user intervention in removing the cause of the excessive heating, such as by disconnecting a portion of an electrical load, or removing an obstruction to proper cooling of an electronic device.

Figure 2:
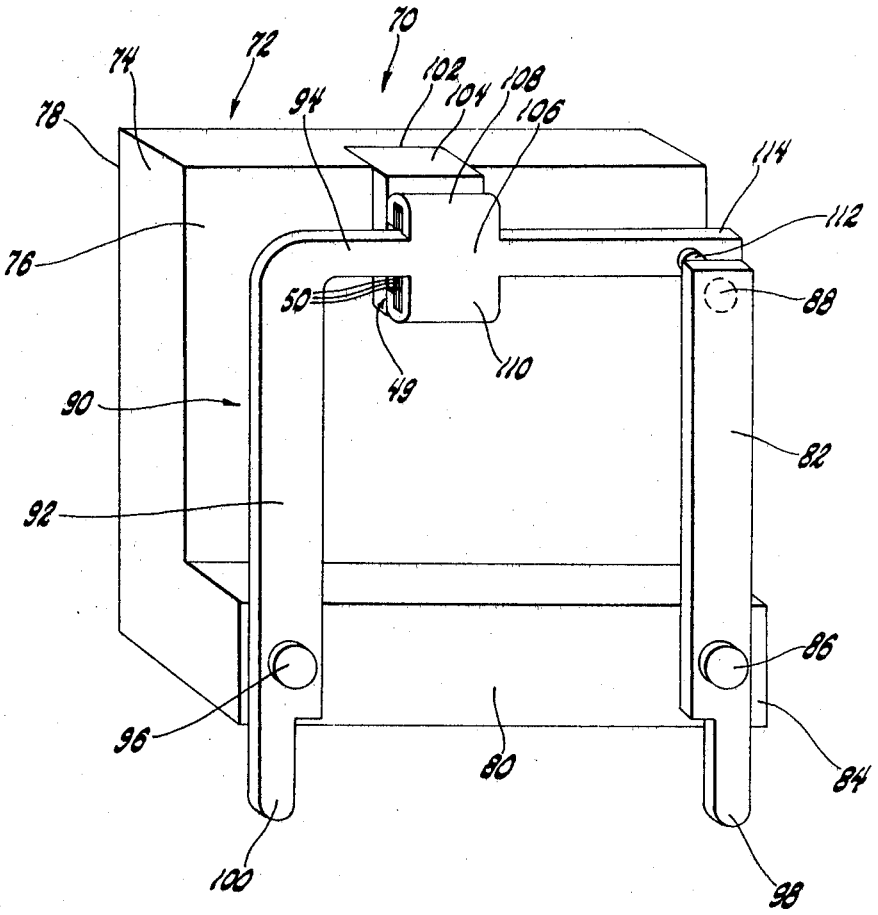
FIG. 2 is a perspective view of a normally open circuit breaker or switch according to a second preferred embodiment of the invention.
Figure 3:
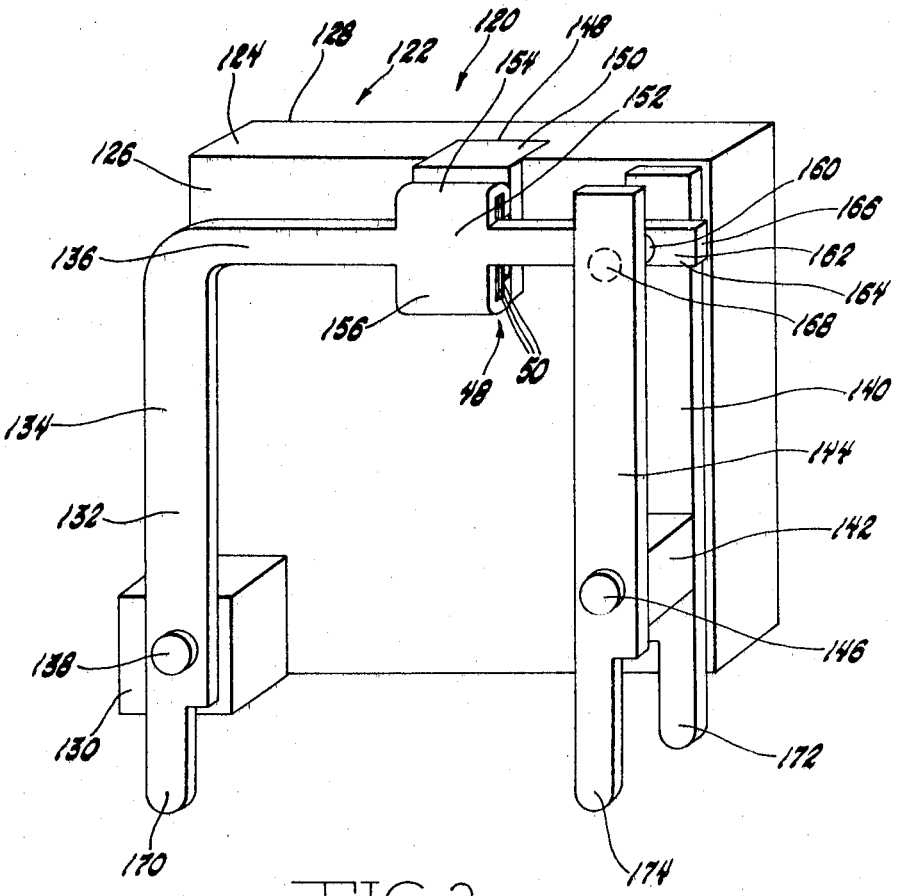
FIG. 3 is a single-pole, double-throw circuit breaker or switch according to a third preferred embodiment of the invention.
Figure 4:
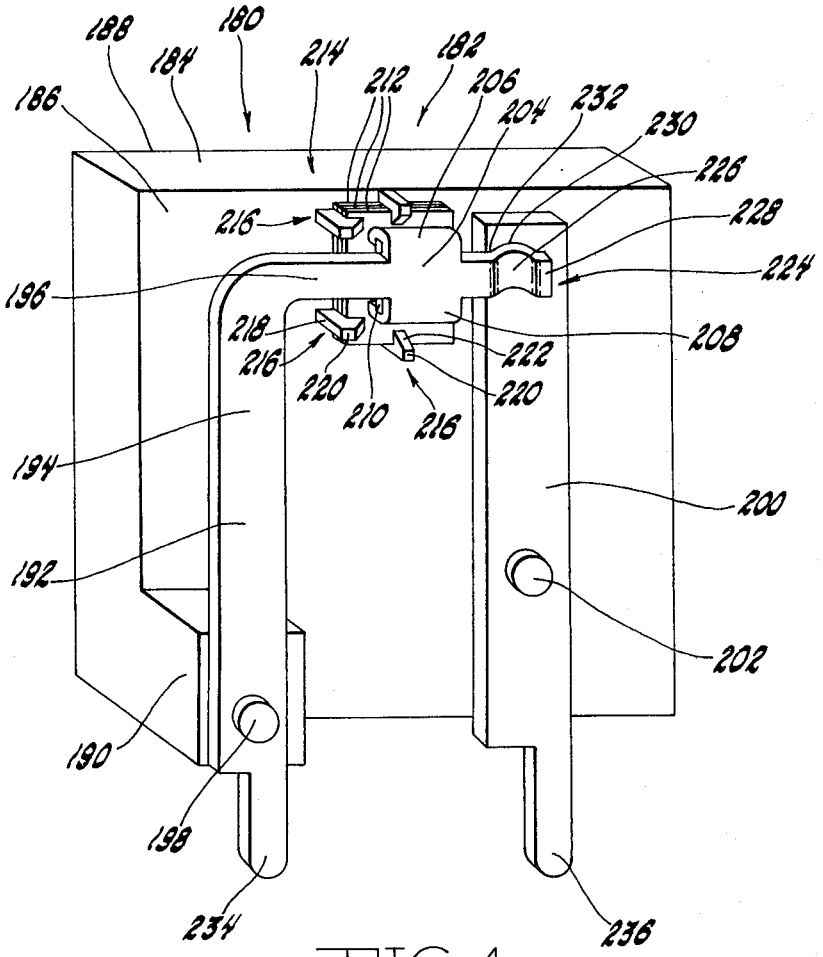
FIG. 4 is a perspective view of a circuit breaker according to a fourth preferred embodiment of the invention, similar to FIG. 1, but with the active elements interchanged.

FIGS. 2, 3 and 4 show other preferred embodiments of the invention, with the contacts in normally open configuration, and single-pole, double-throw configuration, as well as with the positioning of the magnet and the amorphous metallic material interchanged.

In FIG. 2, the illustrated embodiment is arranged as a normally-open, temperature-responsive switch, such as may be appropriate to energize a latching relay to interrupt power to a device upon detection of an over temperature condition. Switch 70 is provided with a base member 72 including a generally-planar portion 74 having a first surface 76 and a second surface 78. Base member 72 also concludes a projecting portion 80, shown as a single projecting portion, although, as will be appreciated, projecting portion 80 could be interrupted to form two separate projections.

A stationary contact member 82 is shown mounted to projection 80 at a first end 84 of projection 80 in a cantilever fashion, and retained by a fastening means shown as a rivet 86. Of course, in place of rivet 86, heat staking or ultrasonic welding of a molded plastic post protruding from first end 84 of projecting portion 80 could also be used to retain stationary contact member 82. As shown, stationary contact member 82 is provided with a contact member 88. Contact member 88 may be made of precious metal, such as silver or gold, and attached by welding, staking, or inlaid into the base metal of stationary contact member 82 in conventional manner. An L-shaped movable contact member 90 includes first and second portions 92 and 94, illustrated as perpendicular to first portion 92. Contact member 90 is mounted in a cantilever fashion to projecting portion 80 by fastening means shown as rivet 96. Stationary contact member 82 and L-shaped movable contact member contain terminal portions 98 and 100, which may be identical to terminal portions 26 and 36 illustrated and described in connection with FIG. 1.

Base member 72 defines a cavity 102, in which a magnet 104 is disposed, and shown projecting a short distance above first surface 76. Magnet 104 may be retained in cavity 102 in any conventional manner, including friction, adhesive, latching fingers and other conventional means.

As shown, second portion 94 includes a widened portion 106 defining a pair of bendable tabs 108 and 110, which are shown bent around, and retaining an amorphous metallic material 48, shown as composed of a plurality of layers 50 of amorphous metallic material. Second portion 94 is also provided with a contact member 112 at an end 114 distal to terminal portion 100, and aligned with contact member 88 for establishing electrical contact between stationary contact member 82 and movable contact member 90. As shown, amorphous material 48 is attracted to magnet 104 when material 48 is at a temperature below its Curie point temperature, maintaining contact members 88 and 112 in separated condition. When amorphous material 48 is heated to its Curie point temperature, either by ambient heating or by Joule heating of current flowing through movable contact member 90, it will cease to be attracted to magnet 104, the inherent resilience of movable contact member 90 causing contact members 88 and 112 to establish electrical and mechanical contact. Contact members 88 and 112 may also be replaced with a contact portion similar to contact portion 58, shown in FIG. 1, where an indentation in one surface forms a protrusion in another to form a defined contact area. Separate contact members such as 88 and 112 would be used when a switch such as switch 70 is intended to carry a high level of current flow.

FIG. 3 shows a switch and circuit breaker with contacts arranged in a single-pole, double-throw manner. As shown, circuit breaker and switch 120 includes a base member 122 including a generally-planar portion 124 having a first surface 126 and a second surface 128, and also including a projecting portion 130 projecting from first surface 126. An L-shaped movable contact member having a first portion 134 and a second portion 136 is supported in a cantilever fashion by projecting portion 130, and is fastened to projecting portion 130 by fastening means shown as a rivet 138. As before, alternate fastening means may also be used. A first stationary contact member is disposed adjacent first surface 126, and a spacer 142 is disposed against first stationary contact member 140 and supports a second stationary contact member in a cantilever fashion. A fastening means shown as a rivet 146 passes through second stationary contact member 144, spacer 142, first stationary contact member 140 and planar portion 124 to retain contact members 140 and 144 in a spaced-apart parallel relationship.

As with the previous embodiments, planar portion 124 defines a cavity 148, in which a magnet 150 is retained in any convenient fashion, including the use of adhesives, friction, latching fingers and other conventional means. Second portion 136 includes a widened portion 152 defining bendable tabs 154 and 156 which are bent around and retain a plurality of layers 50 of amorphous metallic material 48. A contact member 160 is shown disposed at a tip portion 162 of second portion 136, on first surface 164. Another such contact member is preferably disposed on second surface 166 of tip portion 162, and a third such contact is preferably disposed on first stationary contact member 140. As before, these contact members may be made of various conventional materials, and attached in various conventional fashions, if necessary to carry the electrical current for which switch and circuit breaker 130 is to be used.

When the temperature of amorphous metallic material 48 is below its Curie point temperature, it will be attracted to magnet 150, and electrical continuity will be maintained between terminal portion 170 of movable contact member 132 and terminal portion 172 of first stationary contact member 140. When the temperature of amorphous metallic material 48 is raised above its Curie point temperature, either by Joule heating or ambient heating, its attraction to magnet 150 will cease, and the resilience of movable contact member 132 will cause tip portion 162 to move away from first stationary contact member 140 and against second stationary contact member 142, establishing electrical continuity between terminal portion 170 and a terminal portion 174 of second stationary contact member 144.

FIG. 4 illustrates a switch and circuit breaker 180 in accordance with the invention, if the positioning of amorphous metallic material and a magnet opposite to that shown in the preceding figures. Switch and circuit breaker 180 includes a base member 182 including a generally-planar portion 184, having a first surface 186 and a second surface 188, and including a projecting portion 190 projecting from first surface 186. An L-shaped movable contact member 192 including a first portion 194 and a second portion 196, is fastened in a cantilever manner to projecting portion 190 by means of a fastening means shown as a rivet 198. A stationary contact member is disposed against first surface 186 and positioned so as to intersect movable contact member 192 and is fastened against surface 186 by fastening means here shown as rivet 202. Second portion 196 is provided with a widened portion 204 defining first and second bendable tabs 206 and 208, which are bent around and retain a magnet 210 against second portion 196. First surface 186 of generally-planar portion 184 retains a plurality of layers 212 of amorphous magnetic material 214 in conventional manner, such as by a plurality of latching fingers 216, each having an upstanding portion 218 perpendicular to surface 186 and a second portion 220 substantially parallel to surface 186, and having a tapered portion 222 to facilitate insertion of layers 212. As illustrated, contact portion 224 of second portion 196 is provided with a contact defined by an indentation 226 in a first surface 228 of contact portion 224, defining a protrusion 230 on a second surface 232 of portion 224. When amorphous material 214 is at a temperature below its Curie point temperature, magnet 210 will be attracted to it, holding contact portion 224 against stationary contact member 200 and establishing electrical continuity between terminal portion 234 of movable contact member 192 and terminal portion 236 of stationary contact member 200. When amorphous material 214 is heated to a temperature above its Curie point temperature, either by ambient heating, or due to radiation, convection or heat flow arising from heat caused by current flow through movable contact member 192, which is closely adjacent amorphous material 214 under these conditions, movable contact member 192 will move away from stationary contact member 200 due to its inherent resilience, interrupting the current path between terminal portion 234 and 236.

A circuit breaker or switch according to any illustrated embodiment of the invention provides a simplified structure for such device, which is inexpensive to manufacture and dependable in use, having a minimum of parts. For instance, including rivets, if such are used as fastening means rather than staking or ultrasonic welding, the embodiment of FIG. 1 includes only seven pieces, if layers 50 are considered as a single laminated assembly.

In view of the detailed description above, it is believed that it would be obvious to one skilled in the art that many modifications and variations of the illustrated embodiment of the invention are possible, and may be easily made, without departing from the spirit and scope of the invention.

I claim:

1. A switch, comprising:

a base member having a substantially-planar portion having a first surface and a projection portion projecting from said first surface;

an electrically-conductive contact stationary member being permanently attached to said first surface, said stationary terminal member having a connection portion for connection to an electrical circuit;

a magnet fixedly disposed upon said first surface of said planar portion;

a resilient electrically-conductive moveable contact member having a connection portion for connecting to said electrical circuit and a mounting portion fixedly attached to said projecting portion, and a contact portion adapted to contact said stationary contact member;

said moveable contact member including a plurality of layers of amorphous ferromagnetic metal strips having a Curie point temperature, said strips being fastened to said moveable contact member adjacent said magnet;

said plurality of strips of said amorphous ferromagnetic material being attracted to said magnet when said amorphous material is at a temperature below said Curie point temperature, and urging said contact portion of said moveable contact member against said stationary contact member;

said resilient moveable contact member urging said contact portion away from said stationary contact member and moving said contact portion away from said stationary member when said amorphous material is above said Curie point temperature;

said moveable contact member being an L-shaped member having a first portion and a second portion perpendicular to said first portion;

said first portion having a portion affixed to said projecting portion;

said second portion including said contact portion at an end thereof;

said second portion defining a widened portion, said widened portion defining bendable tabs folded about said plurality of layers of amorphous material;

whereby an electrical connection exists between said connector portion of said stationary contact member and said connector portion of said moveable contact member only when said amorphous material is at a temperature below said Curie point temperature.

2. A switch, comprising:

a base member having a substantially-planar portion having a first surface and a projecting portion projecting from said first surface;

an electrically-conductive contact stationary member being permanently attached to said first surface, said stationary terminal member having a connection portion for connection to an electrical circuit;

a magnet fixedly disposed upon said first surface of said planar portion;

a resilient electrically-conductive moveable contact member having a connection portion for connecting to said electrical circuit and a mounting portion fixedly attached to said projecting portion, and a contact portion adapted to contact said stationary contact member;

said moveable contact member including a plurality of layers of amorphous ferromagnetic metal strips having a Curie point temperature, said strips being fastened to said moveable contact member adjacent said magnets;

said plurality of strips of said amorphous ferromagnetic material being attracted to said magnet when said amorphous material is at a temperature below said Curie point temperature, and urging said contact portion of said moveable contact member against said stationary contact member;

said resilient moveable contact member urging said contact portion away from said stationary contact member and moving said contact portion away from said stationary member when said amorphous material is above said Curie point temperature;

a second electrically-conductive contact stationary member being disposed in a spaced-apart parallel relationship to said first mentioned electrically-conductive contact stationary member and maintained in said relationship by spacer means and having a connection portion for connection to an electrical circuit;

said moveable contact member having said contact portion further adapted to contact said second stationary member;

said resilient moveable contact member urging said contact portion against said second stationary member when said amorphous material is above said Curie point temperature to establish an electrical connection between said moveable contact member and said second stationary member;

said moveable contact member being an L-shaped member having a first portion and a second portion perpendicular to said first portion;

said first portion having a portion affixed to said projecting portion;

said second portion including said contact portion at an end thereof;

said second portion defining a widened portion, said widened portion defining bendable tabs folded about said plurality of layers of amorphous material;

whereby an electrical connection exists between said connector portion of said first mentioned stationary contact member and said connector portion of said moveable contact member only when said amorphous material is at a temperature below said Curie point temperature.

3. A switch, comprising:

a base member having a first surface and at least one projecting portion projecting from said first surface;

an electrically conductive contact stationary member being permanently spaced from and parallel to said first surface by said projecting portion and cantilevered from said projecting portion;

a magnet being fixedly disposed upon said first surface of said planar portion;

a resilient electrically-conducitve moveable contact member having a connection portion for connecting to said electrical circuit and a mounting portion fixedly attached to said projecting portion, and a contact portion adapted to contact said stationary member;

said moveable contact member including a plurality of layers of amorphous ferromagnetic material strips having a Curie point temperature;

said strips being fastened to said moveable contact member adjacent said magnet;

said moveable contact member being an L-shaped member having a first portion and a second portion perpendicular to said first portion;

said first portion having a portion affixed to said projecting portion;

said second portion including said contact portion and an end thereof;

said second portion defining a widened portion, said widened portion defining bendable tabs folded about said plurality of layers of amorphous material;

said plurality of strips of said amorphous ferromagnetic material being attracted to said magnet when said amorphous material is at a temperature below said Curie point temperature, and urging said contact portion of said moveable contact member away from said stationary contact member;

said resilient moveable contact member urging said contact portion against said stationary member when said amorphous material is above said Curie point temperature;

whereby an electrical connection exists between said connector portion of said stationary member and said connector portion of said moveable contact member only when said amorphous material is at a temperature above said Curie point temperature.

4. A switch, comprising:

a base member having a first surface and at least one projecting portion projecting from said first surface;

an electrically-conductive contact stationary member solidly affixed to said base member and having a connection portion for connecting to an electrical circuit and disposed to intersect a resilient electrically-conductive moveable contact member;

said moveable contact member having a connection portion for connecting to said electrical circuit and a mounting portion fixedly attached to said projecting portion and a contact member adapted to contact said stationary contact member;

said moveable contact member including a magnet rigidly affixed thereto;

said base member including a plurality of strips of an amorphous ferromagnetic material having a Curie point temperature disposed on said first surface adjacent said magnet;

said moveable contact member defining a widened portion defining bendable tabs folded about said magnet;

said moveable contact member being an L-shaped member having a first portion and a second portion perpendicular to said first portion;

said first portion having a portion affixed to said projecting portion;

said resilient moveable contact member resiliently biasing said magnet away from said amorphous material, said moveable contact member being attracted to and held against said amorphous material only when said amorphous material is at a temperature below said Curie point temperature.

* * * * *